United States Patent [19]

Luyett et al.

[11] 4,364,219

[45] Dec. 21, 1982

[54] APPARATUS FOR SEALING CONTAINERS

[75] Inventors: Joe G. Luyett, Defiance, Mo.; Lawrence W. Ulrich; Connie W. Walker, both of Bolingbrook, Ill.

[73] Assignee: Durable Packaging Corporation, Chicago, Ill.

[21] Appl. No.: 196,617

[22] Filed: Oct. 14, 1980

[51] Int. Cl.[3] ..... B65B 7/20

[52] U.S. Cl. ..... 53/374; 53/381 R

[58] Field of Search ..... 53/137, 374, 381 R, 53/383, 387, 388, 375

[56] References Cited

U.S. PATENT DOCUMENTS

| | | | |
|---|---|---|---|
| 1,217,532 | 2/1917 | Totman | 53/374 X |
| 3,267,640 | 8/1966 | Romney et al. | 53/374 X |
| 3,973,375 | 8/1976 | Loveland | 53/374 |
| 3,977,162 | 8/1976 | Marchetti | 53/374 |
| 4,079,577 | 3/1978 | Ulrich et al. | 53/374 |

*Primary Examiner*—John Sipos
*Assistant Examiner*—Charles L. Willis
*Attorney, Agent, or Firm*—Dressler, Goldsmith, Shore, Sutker & Milnamow, Ltd.

[57] ABSTRACT

An apparatus for automatically sealing cartons which includes a mechanism for automatically infolding the leading and trailing top flaps prior to the application of the adhesive material.

5 Claims, 4 Drawing Figures

APPARATUS FOR SEALING CONTAINERS

BACKGROUND AND SUMMARY OF THE INVENTION

The present invention relates to apparatus for sealing the foldable flaps of cartons of random sizes by applying a self-adhesive tape material along the edges of the flaps, and more particularly to an improved plough mechanism for infolding the leading and trailing top flaps prior to the application of the adhesive tape material.

In the packaging industry, corrugated and fiberboard cartons have been used for many years and various machines have been developed which are capable of sealing such cartons either by gluing the flaps, taping the flaps, or by stapling or otherwise providing mechanical fasteners to maintain the flaps in a closed position. Many of these machines are designed to accept cartons of random width and height by providing various types of sensing means to control the transverse movement of the side arms associated therewith and the vertical movement of the top sealing means. Examples of such machines are disclosed in U.S. Pat. No. 4,044,527 and U.S. Pat. No. 4,079,577, both of which have the same assignee as the present invention.

The present invention is directed to an improvement in the mechanism for automatically infolding the top flaps of the carton as disclosed in U.S. Pat. No. 4,079,577. In particular, the invention is directed to an improved plough mechanism which permits the infolding of leading and trailing flaps which are not already leaning towards their infolded position. Prior to the present invention, other devices have been known for infolding the leading and trailing flaps. These devise have included intricate mechanical and pneumatic mechanisms which require critial adjustments for proper operation. Examples of these prior art devices are disclosed in U.S. Pat. Nos. 3,267,640, 3,623,293 and 3,973,375.

Briefly stated, the plough mechanism in accordance with the present invention includes a plough member, a trailing flap folding member, a leading flap folding member, and means for vertically moving the leading and trailing flap folding members between an up position and a down position. The leading flap folding member is pivotally secured to both the plough member and the trailing flap folding member in such a manner that the included angle between the lower flap contacting surfaces of the leading and trailing flap folding members is obtuse when the leading and trailing flap folding members are in their up position and the leading and trailing flap folding members are in substantially the same horizontal plane when the leading and trailing flap folding members are in their down positions. The flap contacting surfaces of the leading and trailing flap folding members are effective to infold the leading and trailing top flaps as the sealing head means is lowered into contact therewith and the leading and trailing flap folding members are moved to their down position. For a fuller understanding of the nature and objects of the invention, reference should be made to the following detailed description taken in connection with the accompanying drawings.

DESCRIPTION OF A PREFERRED EMBODIMENT

Figure 1:
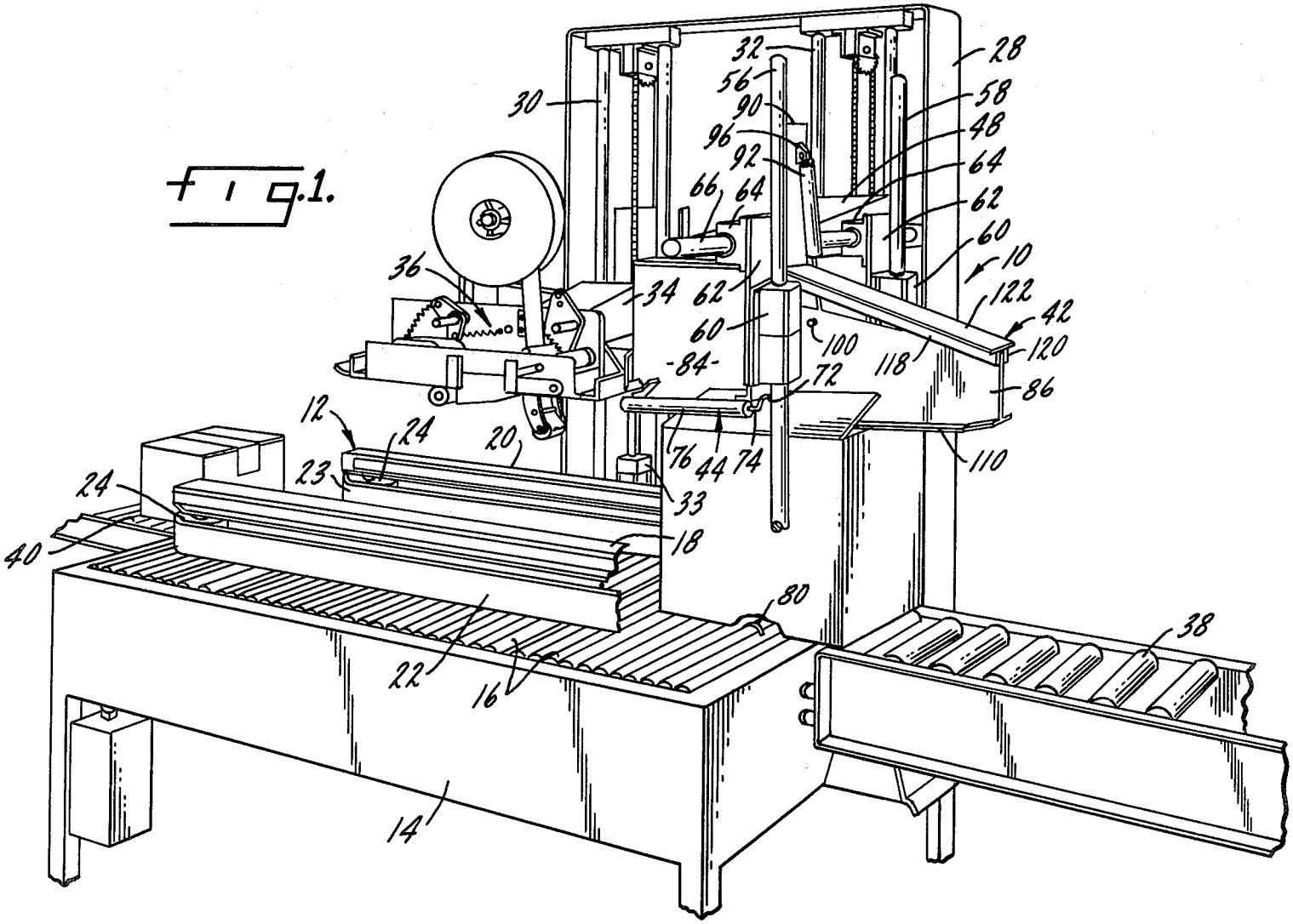
FIG. 1 is a perspective view of the sealing apparatus constructed in accordance with the present invention.

Referring now in detail to the drawings and in particular to FIG. 1, a flap folding mechanism 10 incorporating a plough mechanism 42 constructed in accordance with the present invention is illustrated in combination with a carton sealing apparatus 12 of the type disclosed in U.S. Pat. No. 4,044,527. In order to keep the construction details of the carton sealing apparatus to a minimum, the disclosure of U.S. Pat. No. 4,044,527 is hereby incorporated by reference for such disclosure.

Carton sealing apparatus 12 includes a frame structure 14 for support of plurality of longitudinally spaced carton conveying rollers 16. A pair of transversely spaced and longitudinally extending side arm assemblies 18 and 20 are mounted to frame 14 above rollers 16. The side arm assemblies 18 and 20 are mounted so as to permit simultaneous transverse sliding movement towards and away from each other. Endless conveyor belts 22 and 23 are journaled around rollers 24. Extending vertically upward from frame 14 is a structural vertical lift housing 28. Positioned within housing 28 are a pair of vertical lift assemblies 30 and 32 which are powered by a single pneumatic cylinder 33. Lift assembly 30 is secured to tape head support assembly 34 and is effective to move the tape head assembly 36, associated therewith, up and down above the center longitudinal axis of frame 14. Lift assembly 32 is secured to flap folding mechanism 10. Lift assemblies 30 and 32 move up and down together along with the tape head support assembly 34 and the flap folding mechanism 10 respectively associated therewith. Support assembly 34 and folding mechanism 10 are rigidly secured to one another to effect such simultaneous movement. A powered infeed conveyor 38 is provided to feed cartons onto sealing apparatus 12 and a powered outfeed conveyor 40 is provided to remove sealed cartons from sealing apparatus 12.

As alluded to hereinabove, the present invention is directed to an improvement in the plough mechanism portion of the flap folding mechanism disclosed in U.S. Pat. No. 4,079,577. In order to keep the construction details of the portion of the flap folding mechanism which does not interrelate with the present invention to a minimum, the disclosure of U.S. Pat. No. 4,079,577 is hereby incorporated by reference for such disclosure.

Flap folding mechanism 10 includes a plough mechanism portion 42 for infolding the leading top flap and the trailing top flap and a pair of flap contacting arms 44 for infolding the respective side flaps. Extending transversely inward from lift assembly 32, and vertically movable therewith, is a support assembly 48. Plough mechanism 42 is rigidly secured to the underside of support assembly 48. Guide rods 56 and 58 extend respectively vertically upward from the upper forward surfaces of side arms 18 and 20. Mounted about each of the guide rods 56 and 58 is a bearing assembly 60 in a manner which permits same to move vertically up and down the respective rods. A connecting plate 62, having a bearing 64 associated therewith, is secured to each bearing assembly 60. A connecting rod 66 extends transversely through the respective bearings 64 so as to effect unison vertical movement of the bearing assemblies 60 to permit transverse movement of bearings 64. Connecting rod 66 is rigidly secured at an intermediate point to support assembly 48. Flap contacting arms 44 are secured to a respective bearing assembly 60. Contacting arms 44 include a transverse portion 72 which is secured to the bearing assembly and a longitudinal portion 74 which is bent to extend inwardly of the respective side arms 18 and 20. Portion 74 preferably extends slightly inwardly in the direction of movement of the carton to be sealed. Journaled for rotation about each longitudinal portion 74 is a roller member 76.

From the foregoing description of flap closing mechanism 10, it should be readily apparent that the vertical movement of support assembly 48 is effective to move plough mechanism 42 and arms 44 up and down therewith. Further, the transverse movement of side arms 18 and 20 is effective to move contacting arms 44 inward and outward therewith.

Figures 2, 3, 4:
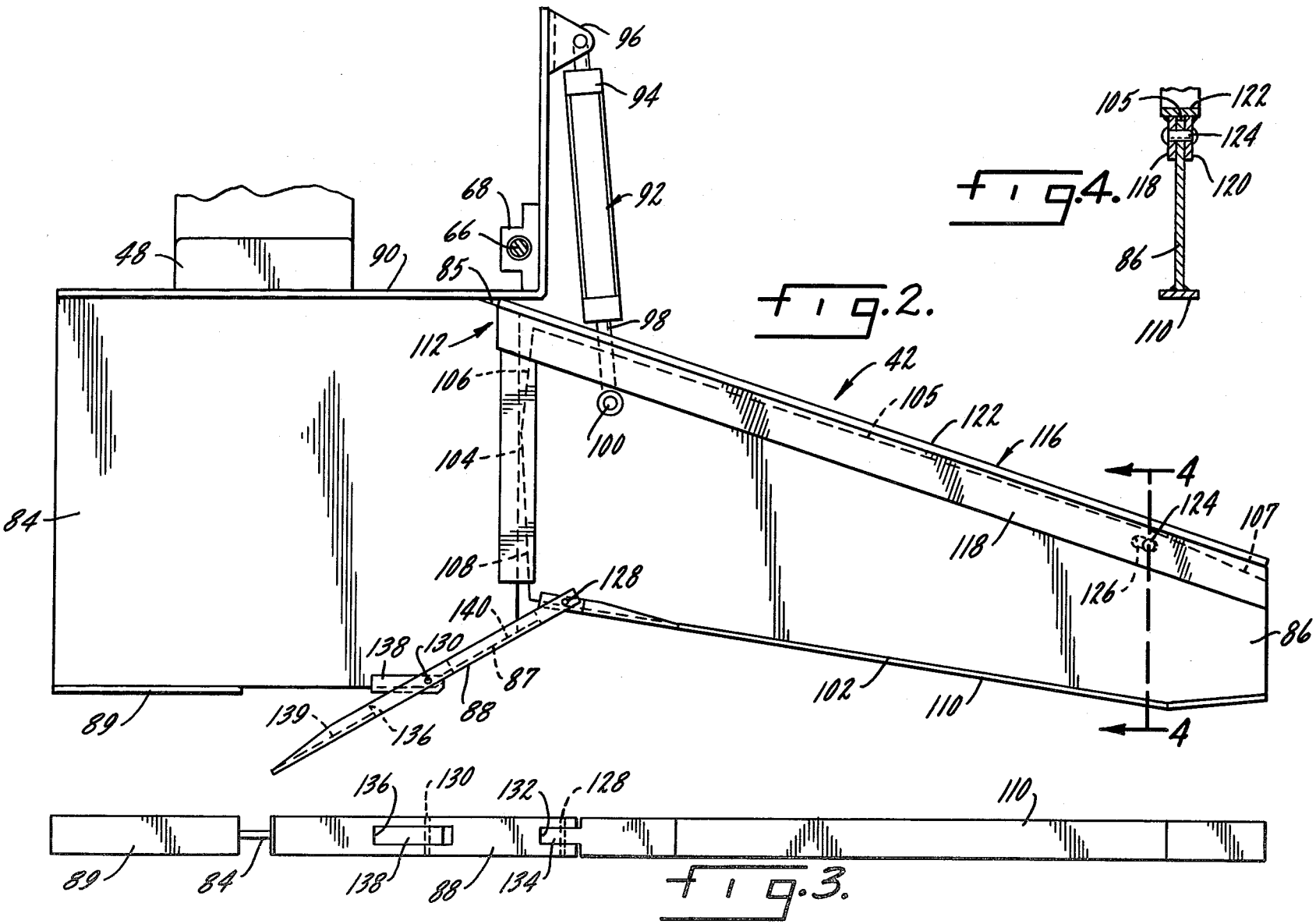
FIG. 2 is a front elevational view of the plough mechanism constructed in accordance with the present invention with the leading and trailing flap folding members in their up positions.
FIG. 3 is a bottom plan view of the plough mechanism as shown in FIG. 2.
FIG. 4 is a sectional view taken along line 4—4 in FIG. 2.

Referring specifically to FIGS. 2–4, plough mechanism 42 includes a plough member 84, a trailing flap folding member 86, and a leading flap folding member 88. Plough member 84 is rigidly secured to the underside of support assembly 48 through an angle bracket 90 which in turn is secured to rod 66 through a clamp 68. Plough member 84 is a longitudinally extending rectangular plate, positioned in a vertical plane passing through the longitudinal center axis of apparatus 12, having its upper and lower inner corners cut off, as indicated respectively at 85 and 87, to accomodate movement of members 86 and 88. The outer portion of the lower edge of member 84 terminates in a flat horizontal flange 89 which, as will herein below be further discussed, contacts the leading top flap.

Trailing flap folding member 86 extends longitudinally forward of member 84 and in the same vertical plane therewith. Member 86 is supported from bracket 90 through a double-acting pneumatic cylinder unit 92. Cylinder unit 92 includes a cylinder portion 94 pivotally connected to bracket 90, through a clevis bracket 96, and a piston rod portion 98 pivotally connected to an upper portion of the inner end of member 86 through a suitable pivot rod assembly 100. The cylinder unit 92 serves to effect a controlled vertical movement of the inner end of member 86. As seen in FIG. 2, the shape of member 86 is such that when member 86 is in its up position, its lower edge 102, inclines downwardly and outwardly from a point adjacent member 84, and above the lower edge thereof, to a point a short distance from its outer end where it turns to an upward inclination. The inner edge 104 of member 86 is angled at 106 and 108 to permit rotational movement of member 86 relative to member 84. Edge 102 terminates in a flat horizontal flange 110 which, as will herein below be further discussed, contacts the trailing top flap.

As best seen in FIGS. 2 and 4, a support assembly 112 is provided to support the outer end of member 86 in a manner which permits the inner end of member 86 to move between its up and down positions. Assembly 112 includes a pair of plate members 114 which sandwich member 84 therebetween and are rigidly secured thereto adjacent the inner edges thereof. Plates 114 overlap the inner edge 104 of member 86 so as to permit movement of member 86 therebetween. A channel structure 116, which is formed by a pair of upstanding plate members 118 and 120 and a top plate 122, is positioned over the upper edge 105 of member 86 so as to permit the movement of member 86 therein. Channel 116 is rigidly secured to the upper ends of plate members 114 at its inner end and moveably secured to the outer end of member 86 at its outer end by use of a connecting pin 124 which passes through an elongated slot 126 in member 86. As seen in FIG. 2, the upper edge of member 86 is slightly angled at 107 to accomodate the movement of member 86 within channel 116.

Referring to FIGS. 2 and 3, leading flap folding member 88 is pivotally secured to member 86 about horizontal pivot pin 128 and pivotally secured to member 84 about horizontal pivot pin 130. Member 88 is formed with a cut out section 132 at its inner end which receives a connecting portion 134 formed at the inner end of flange 110. Pin 128 passes through member 88 at cut out portion 132 and connecting portion 134. Member 88 is also formed with a central cut out section 136 which receives a connector plate 138 rigidly secured to the lower edge of member 84 adjacent the cut off portion 87 of member 84. Pin 130 passes through member 88 at cut out 136 and member 84 at connector plate 138. Member 88 has a groove 139 formed in the upper surface thereof outwardly from cut out 136 for receipt of the lower edge of member 84 therein when member 88 is in its down position. Member 88 has a groove 140 formed in the upper surface thereof inwardly from cut out 136 for receipt of the portion 87 of member 84 therein when member 88 is in its up position. Member 88 is dimensioned such that when it and member 86 are in their down positions a substantially uninterupted horizontal surface is formed by the lower surface of portion 89 of member 84, member 88 and plough 110 of member 86.

To control the sequential movement of the side arm assemblies 18 and 20, the vertical lift assemblies 30 and 32, and plough mechanism 42, a pneumatic switching system 80 is provided to sense the relative position of the carton as it enters and proceeds through the apparatus 12. Pneumatic switch 80 is secured to frame 14 immediately below plough mechanism 42 adjacent rollers 16. Switch 80 is operative to contact the leading edge of the carton and cause lift sections 30 and 32 to move downward and also start a first time delay to initiate a downward bias of cylinder 92 to retain plough mechanism 42 in its down position and to initiate inward movement of side arm assemblies 18 and 20. Switch 80 initiates a second built-in time delay which is activated by the trailing edge of the carton to retain the tape head assembly in its down position and the side arms in contact with the carton for the predetermined period of time necessary to deliver the carton to the outfeed conveyor 40. The specific pneumatic system and switching system required to function in the manner hereinabove described is of convention design and not an integral part of the present invention, and consequently a detailed description thereof is not deemed necessary.

The modus operandi of the apparatus 12 in accordance with the invention will now be described with reference to the drawings as described above.

At the start of operation, side arms 18 and 20 are at their outermost positions and lift assemblies 30 and 32 are in their uppermost positions. Also, plough mechanism 42 is in its up position, as shown in FIG. 2, with cylinder 92 exerting an upward bias on member 86 of approximately 12 p.s.i. As the carton to be sealed moves inward from conveyor 38 onto rollers 16 of apparatus 12, its leading edge contacts and activates switch 80. Activation of switch 80 immediately initiates the downward movement of lift sections 30 and 32. As the lift section moves downward, the flange 110 of member 86 contacts and infolds the trailing end flap of the carton and member 88 contacts and infolds the leading end flap of the carton. As members 86 and 88 move downward and contact the upper ends of the end walls of the carton, the downward force on the lift assemblies is sufficient to overcome the upward bias on member 86 causing member 86 to pivot about pin 124 and member 88 to pivot about pins 128 and 130 until flange 110 of member 86 and the lower edge of member 88 are in a horizontal or down position, as particularly shown in FIG. 1. After the first time delay built into switch 80, the upward bias on member 86 through cylinder 92 is changed to a downward bias on member 86 through cylinder 92 of approximately 75 p.s.i. so as to retain plough mechanism 42 in its down position and the side arms 18 and 20 move inward into contact with the side walls of the carton. As the side arms move inward, the contacting arms 44, and rollers 76 associated therewith, contact and infold the side flaps of the carton.

The conveyor belts 22 and 23 of the side arms 18 and 20 remain in contact with the sides of the carton and move it past the tape head assembly 36 where a strip of sealing tape is applied across the top surfaces of the side flaps and the upper portions of the end walls. As the trailing edge of the carton passes over switch 80, the switch is deactivated and a second time delay is activated and a short time thereafter the side arms 18 and 20, lift assemblies 18 and 20, and plough mechanism 42 are returned to their initial positions to receive the next carton to be sealed. The second time delay is of sufficient duration to permit the sealed carton to be delivered to conveyor 40.

The foregoing is a description of a preferred embodiment of the invention which is given here by way of example. The invention is not to be taken as limited to any of the specific features as described, but comprehends all such variations thereof as come within the scope of the appended claims.

What is claimed is:

1. In combination with apparatus of the type used for sealing the foldable flaps of cartons, said apparatus including a frame structure and a vertically movable sealing head support assembly means mounted to said frame structure; and an improved plough mechanism secured to said sealing head support assembly means and movable therewith for infolding the leading and trailing top flaps, comprising:

(a) a plough member rigidly secured to said sealing head support assembly means and movable therewith;

(b) a longitudinally extending trailing flap folding member pivotally mounted at an outer end thereof to said sealing head support assembly means and slidably and pivotally mounted at an inner end thereof to said plough member;

(c) a leading flap folding member pivotally secured about a substantially horizontal axis at an outer portion thereof to said plough member and pivotally secured about a substantially horizontal axis at an inner portion thereof to said inner portion of said trailing flap folding member; and (d) means for vertically moving, said sealing head support assembly means so that the inner ends of said trailing flap folding member and said leading flap folding member secured thereto are moved between an up position and a down position relative to said plough member such that the included angle between the lower flap contacting surfaces of said leading flap folding member and said trailing flap folding member is obtuse when said leading flap folding member and said trailing flap folding member are in their up position and the flap contacting surfaces of said leading flap folding member and said trailing flap folding member are in substantially the same horizontal plane when said leading flap folding member and said trailing flap folding member are in their down position;

(e) said flap contacting surfaces of said leading flap folding member and said trailing flap folding member being effective to respectively infold the leading and trailing top flaps as said plough mechanism is lowered into contact therewith and said trailing flap folding member and said leading flap folding member are moved to their down positions.

2. The invention as defined in claim 1 wherein said plough member, said trailing flap folding member and said leading flap folding member are in substantially the same vertical plane.

3. The invention as defined in claim 2 wherein said sealing head support assembly means includes a support assembly for supporting the outer end of said trailing flap folding member so as to permit said inner end thereof to move between its up position and its down position.

4. The invention as defined in claim 1 wherein said means for vertically moving the inner end of said trailing flap folding member also vertically moves said plough mechanism into contact with the top edges of the end walls of the carton, and a biasing means is provided for biasing said trailing flap folding member towards its up position with an upward force which is less than the downward force exerted by said means when said plough mechanism is in contact with the top edges of the end walls of the cartons so as to cause said trailing flap folding member and said leading flap folding member to move into their down position.

5. The invention as defined in claim 4 wherein said biasing means is a pneumatic cylinder secured at one end to said sealing head support assembly means and at the other end to an inner portion of said trailing flap folding member.

* * * * *